US011538620B2

(12) United States Patent
Jeon et al.

(10) Patent No.: US 11,538,620 B2
(45) Date of Patent: Dec. 27, 2022

(54) COIL ELECTRONIC COMPONENT

(71) Applicant: SAMSUNG ELECTRO-MECHANICS CO., LTD., Suwon-si (KR)

(72) Inventors: Hyung Jin Jeon, Suwon-si (KR); Soon Kwang Kwon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 366 days.

(21) Appl. No.: 16/834,250

(22) Filed: Mar. 30, 2020

(65) Prior Publication Data

US 2021/0027933 A1 Jan. 28, 2021

(30) Foreign Application Priority Data

Jul. 24, 2019 (KR) ..... 10-2019-0089739

(51) Int. Cl.
*H01F 27/28* (2006.01)
*H01F 27/29* (2006.01)
(Continued)

(52) U.S. Cl.
CPC ..... *H01F 27/2804* (2013.01); *H01F 17/0013* (2013.01); *H01F 17/04* (2013.01);
(Continued)

(58) Field of Classification Search
CPC ..... H01F 17/0013; H01F 17/04; H01F 2017/048; H01F 27/292; H01F 2017/0066;
(Continued)

(56) References Cited

U.S. PATENT DOCUMENTS

2010/0156344 A1* 6/2010 Inoue ..... H01M 10/46 320/108
2016/0180995 A1 6/2016 Park et al.
(Continued)

FOREIGN PATENT DOCUMENTS

CN 108140468 A 6/2018
CN 110047645 A 7/2019
(Continued)

OTHER PUBLICATIONS

Office Action issued in corresponding Korean Patent Application No. 10-2019-0089739 dated Jul. 16, 2020, with English translation.
(Continued)

*Primary Examiner* — Ryan Johnson

(74) *Attorney, Agent, or Firm* — Morgan, Lewis & Bockius LLP

(57) ABSTRACT

A coil electronic component includes a support substrate, a coil pattern disposed on at least a surface of the support substrate and having a core region in the center of the coil pattern, at least one metal thin plate disposed on an upper portion of the coil pattern and having a shape bent toward the core region, an encapsulant sealing at least a portion of the support substrate, the coil pattern, and the at least one metal thin plate, and an external electrode disposed outside of the encapsulant and connected to the coil pattern.

14 Claims, 5 Drawing Sheets

(51) Int. Cl.

| | |
|---|---|
| ***H01F 27/32*** | (2006.01) |
| ***H01F 17/00*** | (2006.01) |
| ***H01F 17/04*** | (2006.01) |
| ***H01F 27/02*** | (2006.01) |

(52) U.S. Cl.
CPC ..... *H01F 27/022* (2013.01); *H01F 27/292* (2013.01); *H01F 27/327* (2013.01); *H01F 2017/048* (2013.01); *H01F 2027/2809* (2013.01)

(58) Field of Classification Search
CPC ..... H01F 27/022; H01F 27/25; H01F 27/327; H01F 27/36; H01F 27/366; H01F 27/2804; H01F 1/28; H01F 1/20
See application file for complete search history.

(56) References Cited

U.S. PATENT DOCUMENTS

| | | | |
|---|---|---|---|
| 2016/0181002 | A1 | 6/2016 | Kim et al. |
| 2016/0189863 | A1* | 6/2016 | Park ..... H01F 17/04 29/602.1 |
| 2016/0276096 | A1 | 9/2016 | Moon et al. |
| 2016/0293316 | A1 | 10/2016 | Park et al. |
| 2017/0309388 | A1 | 10/2017 | Park et al. |
| 2018/0308612 | A1 | 10/2018 | Park et al. |
| 2019/0221351 | A1 | 7/2019 | Jeong et al. |
| 2020/0143972 | A1 | 5/2020 | Park et al. |

FOREIGN PATENT DOCUMENTS

| | | | |
|---|---|---|---|
| JP | 3373350 | B2 | 2/2003 |
| JP | 2020-072260 | A | 5/2020 |
| KR | 10-2016-0076656 | A | 7/2016 |
| KR | 10-2016-0112185 | A | 9/2016 |
| KR | 10-2016-0118052 | A | 10/2016 |
| KR | 10-1681406 | B1 | 12/2016 |

OTHER PUBLICATIONS

Chinese Office Action dated Dec. 3, 2021 , issued in corresponding Chinese Patent Application No. 202010448782.0.

* cited by examiner

COIL ELECTRONIC COMPONENT

CROSS-REFERENCE TO RELATED APPLICATION(S)

This application claims the benefit of priority to Korean Patent Application No. 10-2019-0089739 filed on Jul. 24, 2019 in the Korean Intellectual Property Office, the disclosure of which is incorporated herein by reference in its entirety.

TECHNICAL FIELD

The present disclosure relates to a coil electronic component.

BACKGROUND

With the miniaturization and thinning of electronic devices such as digital TVs, mobile phones, and laptop PCs, coil components used in these electronic devices are required to be made smaller and thinner. To satisfy these purposes, the research and development of coil electronic components having various forms of wirings or thin films are being actively conducted.

A main issue according to the miniaturization and thinning of coil electronic components is to provide the same properties as conventional coil components, regardless of such miniaturization and thinning. In order to satisfy this requirement, it is necessary for a ratio of a magnetic material to be increased in a core filled with the magnetic material, but there is a limit to increasing the ratio due to the strength of an inductor body and the change in frequency characteristics caused by insulation properties.

In the case of the coil electronic component, attempts have been made to further reduce a thickness of a chip depending on changes in complexity of a recent set, multifunctionality, slimness, and the like. Accordingly, in the art, a method for ensuring high performance and reliability even with the trend for slimness of chips is required.

SUMMARY

An aspect of the present disclosure is to improve flow of magnetic flux in a body and improve permeability, so as to improve performance of a coil electronic component.

According to an aspect of the present disclosure, a novel structure of a coil electronic component is proposed, and, in detail, the coil electronic component includes a support substrate, a coil pattern disposed on at least a surface of the support substrate and having a core region in the center of the coil pattern, at least one metal thin plate disposed on an upper portion of the coil pattern and having a shape bent toward the core region, an encapsulant sealing at least a portion of the support substrate, the coil pattern, and the at least one metal thin plate, and an external electrode disposed outside of the encapsulant and connected to the coil pattern.

The metal thin plate may be provided as a plurality of metal thin plates and the plurality of metal thin plates may be stacked in a thickness direction of the support substrate.

A metal thin plate, of the plurality of metal thin plates, further adjacent to the coil pattern, may have a wider region bent toward the core region.

A plurality of magnetic particles may be filled in an interior of the encapsulant.

At least a portion of the plurality of magnetic particles may be disposed between the plurality of metal thin plates.

The plurality of magnetic particles and the plurality of metal thin plates may include the same material.

The same material may include an Fe-based alloy.

A region, of the at least one metal thin plate, disposed in an upper portion of the coil pattern, may have a flat shape.

A region of the at least one metal thin plate may be disposed between the coil pattern and an outer side surface of the encapsulant.

According to another aspect of the present disclosure, a coil electronic component includes a support substrate, a coil pattern disposed in at least a surface of the support substrate and having a core region in the center of the coil pattern, a plurality of metal thin plates disposed in an upper portion of the coil pattern, an encapsulant sealing at least a portion of the support substrate, the coil pattern, and the at least one metal thin plate, and filled with a plurality of magnetic particles, and an external electrode disposed outside of the encapsulant and connected to the coil pattern, and at least a portion of the plurality of magnetic particles may be disposed between the plurality of metal thin plates.

The plurality of magnetic particles and the plurality of metal thin plates may include the same material.

The same material may include an Fe-based alloy.

Other features and aspects will be apparent from the following detailed description, the drawings, and the claims.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
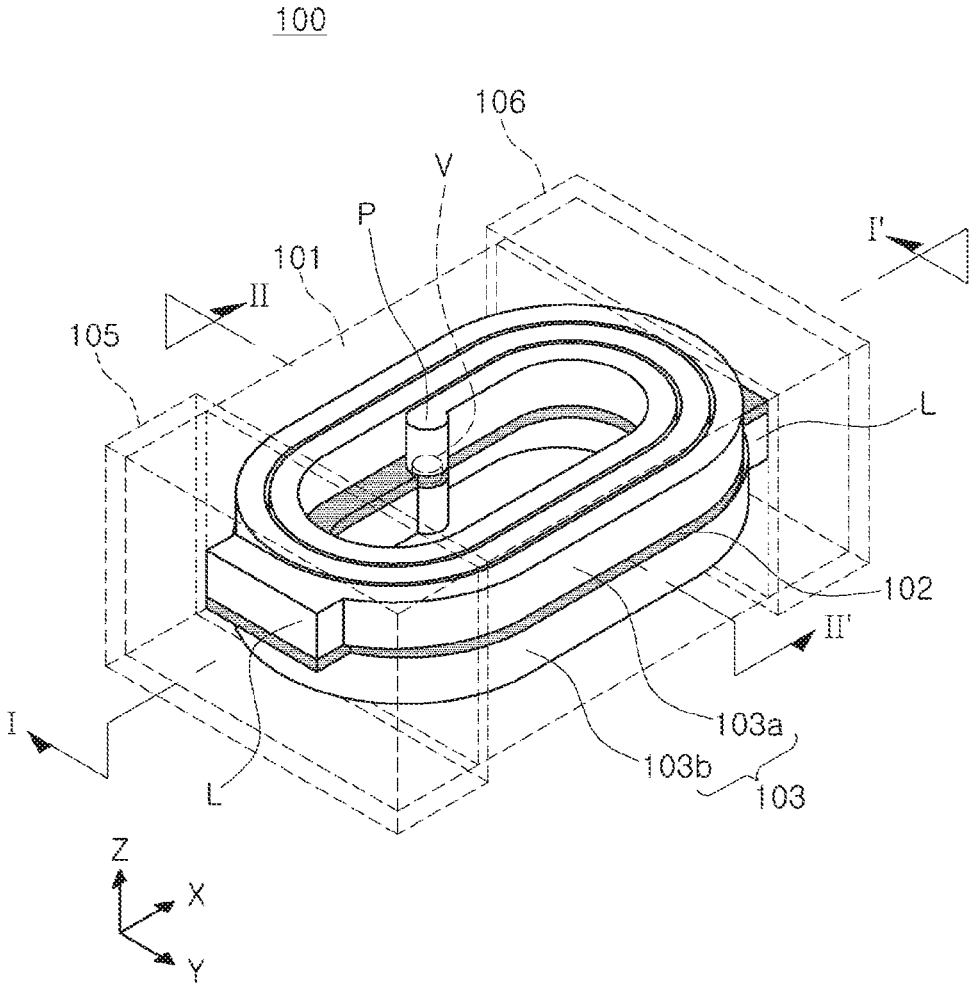
FIG. 1 is a schematic penetration perspective view illustrating a coil electronic component according to an embodiment.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" other elements would then be oriented "below," or "lower" the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted by one or a combination thereof.

The contents of the present disclosure described below may have a variety of configurations and propose only a required configuration herein, but are not limited thereto.

Figure 2:
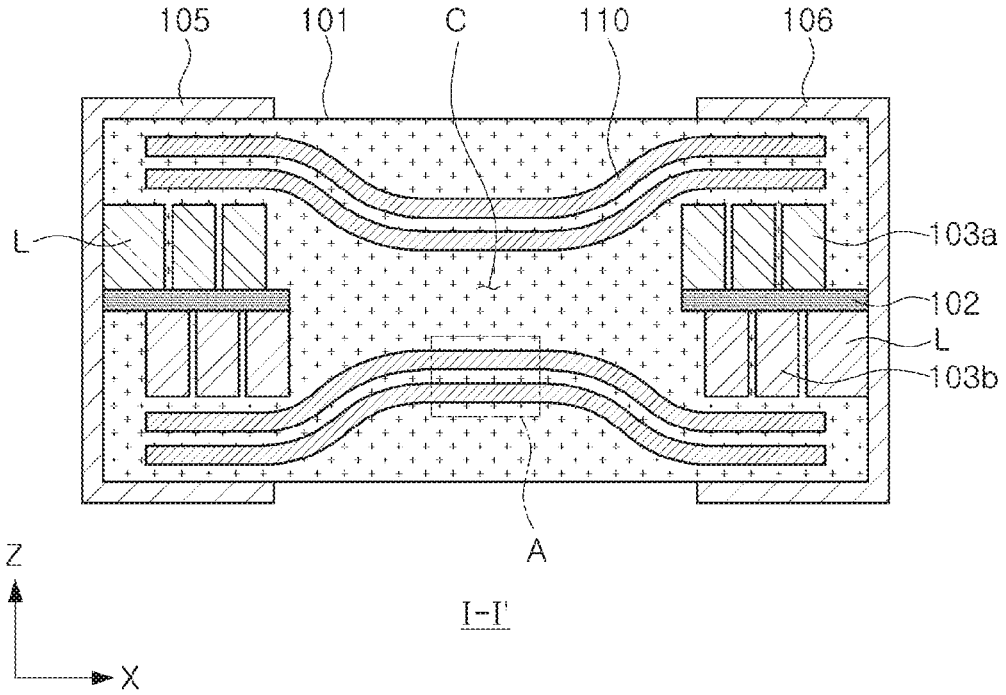
FIG. 2 is a cross-sectional view taken along line I-I' of FIG. 1.
Figure 3:
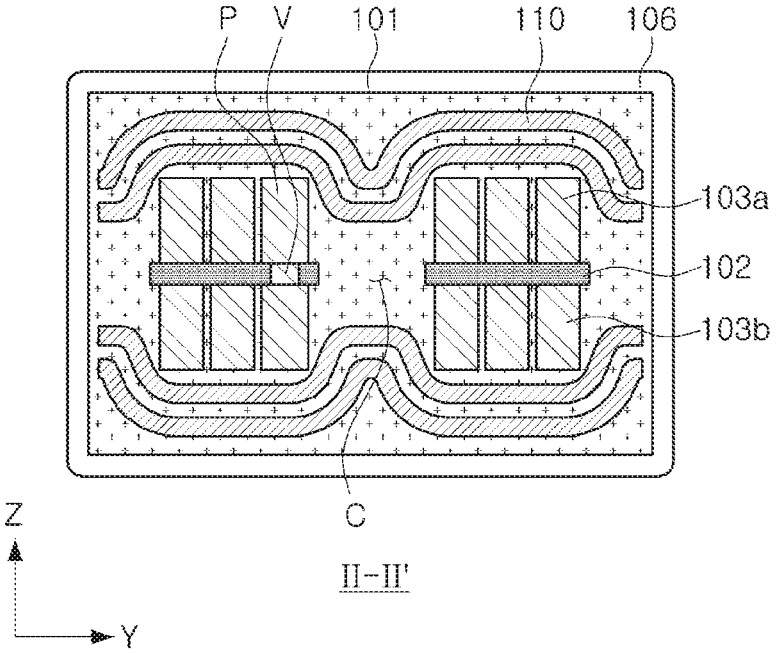
FIG. 3 is a cross section taken along line II-II' of FIG. 1.
Figure 4:
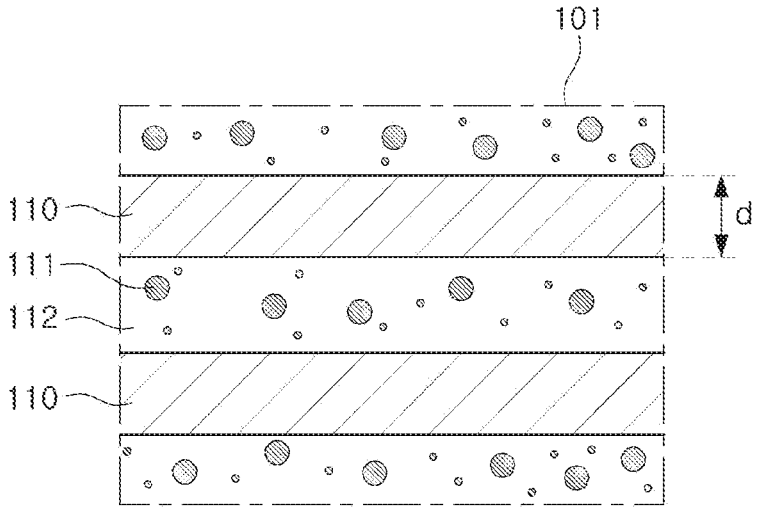
FIG. 4 illustrates an enlarged region A as a form of an encapsulant and a metal thin plate to be employed.
Figure 5:
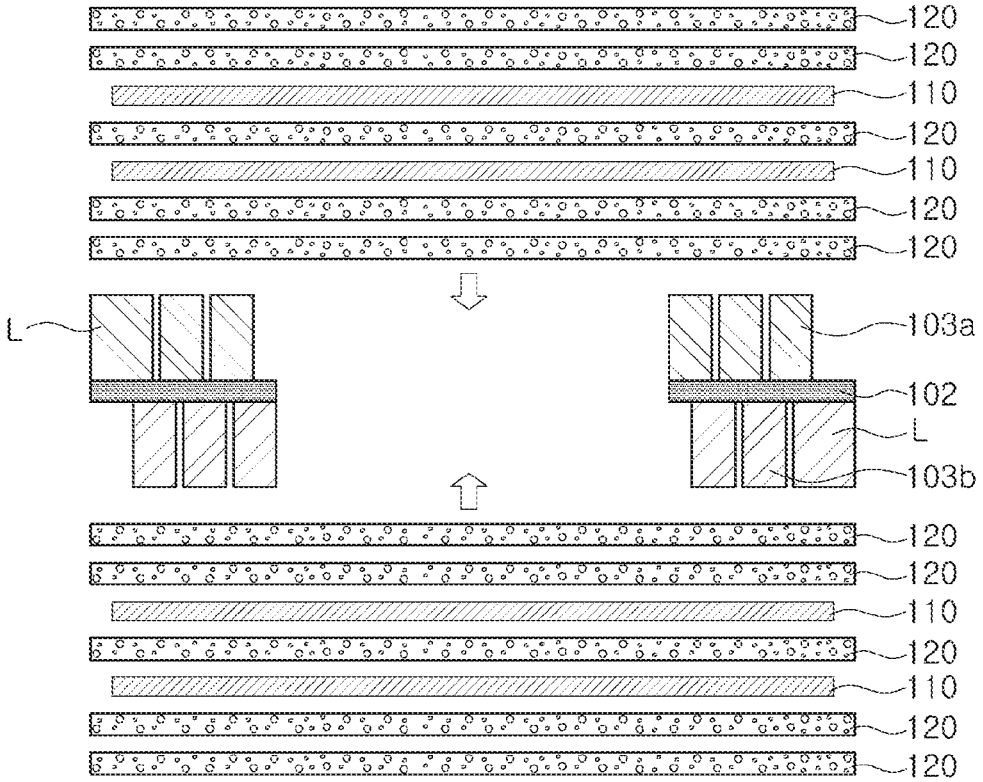
FIG. 5 illustrates an example of formation of an encapsulant of a coil electronic component.

FIG. 1 is a schematic penetration perspective view illustrating a coil electronic component according to an embodiment. FIGS. 2 and 3 are a cross-sectional view taken along line I-I' and a cross-sectional view taken along line II-II' of FIG. 1, respectively. FIG. 4 illustrates an enlarged region A as a form of an encapsulant and a metal thin plate to be employed. FIG. 5 illustrates an example of formation of an encapsulant of a coil electronic component.

Referring to FIGS. 1 to 5, a coil electronic component 100 according to an embodiment of the present disclosure includes a support substrate 102, a coil pattern 103, an encapsulant 101, at least one metal thin plate 110, and external electrodes 105 and 106.

The encapsulant 101 may form an appearance of a coil electronic component 100 while encapsulating at least a portion of the support substrate 102, the coil pattern 103, and the metal thin plate 110. In this case, the encapsulant 101 may be formed to expose a region of a lead-out pattern L, connected to the coil pattern 103, externally. As illustrated in FIG. 4, the encapsulant 101 may include a plurality of magnetic particles 111, and an insulating resin 112 may be interposed between the magnetic particles. Moreover, an insulating film may be coated on a surface of the magnetic particles. As a plurality of magnetic particles 111 are included in the encapsulant 101, permeability of the encapsulant 101 may be improved. Accordingly, performance of the coil electronic component 100 may be improved.

The magnetic particles 111, which may be included in the encapsulant 101, may be ferrite, metal, or the like. In the case of the metal, the magnetic particles may be formed of an iron (Fe)-based alloy, or the like, byway of example. In detail, the magnetic particles 111 may be formed of a nanocrystalline-based alloy of Fe—Si—B—Cr, a Fe—Ni-based alloy, or the like. As described above, when the magnetic particles 111 are formed of the Fe-based alloy, magnetic properties such as magnetic permeability are excellent, but may be vulnerable to Electrostatic Discharge (ESD). Thus, an additional insulating structure may be interposed between the coil pattern 103 and the magnetic particles.

The coil pattern 103 may have a spiral structure forming one or more turns, and may be formed on at least one surface of the support substrate 102. In an embodiment, an example is described, in which the coil pattern 103 includes first and second coil patterns 103*a* and 103*b*, disposed on two surfaces, opposing each other, of the support substrate 102. In this case, the first and second coil patterns 103*a* and 103*b* may include a pad region P, and may be connected to each other by a via V passing through the support substrate 102. The coil pattern 103 may be formed using a plating process used in the art, such as pattern plating, anisotropic plating, isotropic plating, or the like, and may be formed to have a multilayer structure using a plurality of processes among those processes described above. As illustrated in the drawings, the coil pattern 103 has a core region C in the center thereof. The core region C of the coil pattern 103 may be filled with the encapsulant 101.

The lead-out pattern L is disposed in an outermost portion of the coil pattern 103 to provide a connection path with the external electrodes 105 and 106, and may have a structure formed integrally with the coil pattern 103. In this case, as illustrated in the drawings, for connection with the external electrodes 105 and 106, the lead-out pattern L may have a form having a width greater than that of the coil pattern 103. Here, the width corresponds to a width in an X direction with reference to FIG. 1.

In the case of the support substrate 102, supporting the coil portion 103, may be provided as a polypropylene glycol (PPG) substrate, a ferrite substrate, a metal-based soft magnetic substrate, or the like. As illustrated in the drawings, a through-hole is formed in a central portion of the support substrate 102, and the through-hole may be filled with the encapsulant 101.

The metal thin plate 110 is disposed in an upper portion of the coil pattern 103, and has a shape bent toward the core region C. At least one metal thin plate 110 is provided inside the encapsulant. In an embodiment, the metal thin plate is provided as a plurality of metal thin plates and the plurality of metal thin plates may be stacked in a thickness direction of the support substrate 102. The metal thin plate 110 includes a magnetic metal. The magnetic metal may be an Fe-based alloy, or the like, byway of example. In detail, the metal thin plate 110 may be formed of a nanocrystalline-based alloy of Fe—Si—B—Cr, a Fe—Ni-based alloy, or the like. Moreover, the plurality of magnetic particles 111 and the plurality of metal thin plates 110 may include the same material, and the same material may include an Fe-based alloy.

As the plurality of metal thin plates 110 are disposed inside the encapsulant 101, permeability of the encapsulant 101 may be improved. When the magnetic particles 111 are only disposed inside the encapsulant 101, there is a limit to improving permeability of the encapsulant 101. However, with the metal thin plate 110, a magnetic material in the form of a thin plate, an amount of magnetic materials inside the encapsulant 101 may be increased, so a high level of permeability may be implemented. In this case, a thickness d of the metal thin plate 110 is set in consideration of a thickness of the encapsulant 101, permeability, or the like, and may be several tens to hundreds μm, by way of example.

Regarding a shape of the metal thin plate 110, it may have a path the same as or similar to flow of a magnetic field of the coil electronic component 100. Accordingly, an effect of improving permeability of the encapsulant 101 may be significantly improved. In detail, as illustrated in the drawings, the metal thin plate 110 may have a shape bent toward the core region C. In this case, a region, disposed in an upper portion of the coil pattern 103, of the metal thin plate 110, may have a flat shape. Here, when the metal thin plate 110 is disposed in an upper portion of the coil pattern 103, it means that the coil pattern 103 is disposed between the metal thin plate 110 and the support substrate 102. Thus, when referring to the drawings, it may be considered that the metal thin plate 110 is disposed in an upper portion of the first coil pattern 103*a* and a lower portion of the second coil pattern 103*b*. Moreover, as illustrated in FIG. 3, a region of the metal thin plate 110 may be disposed between the coil pattern 103 and an outer side surface of the encapsulant 110. The metal thin plate 110 in the form described above may have a shape similar to 'W' as a whole. In this regard, the shape, described above, is similar to flow of a magnetic field of the coil electronic component 100, thereby contributing to the improvement of magnetic properties of the encapsulant 101.

When the metal thin plate 110 is bent toward the core region C as described above, a metal thin plate, of the plurality of metal thin plates 110, further adjacent to the coil pattern 103, has a wider region bent toward the core region C. The form of the metal thin plate 110 may be obtained through a stacking process of FIG. 5. As an example of implementing the encapsulant 101, as illustrated in FIG. 5, a method may be used, in which a plurality of insulating layers 120 and metal thin plates 110 are stacked, and then pressed. In this case, the insulating layer 120 may have a form in which magnetic particles are dispersed in an insulating resin. Moreover, in order not to expose the metal thin plate 110 to an exterior of the encapsulant 101, the metal thin plate 110 may have a width narrower than that of the insulating layer 120. The insulating layer 120 and the metal thin plate 110 are provided as a plurality of insulating layers and a plurality of metal thin plates, and those are placed in the proper order and stacked to cover the coil pattern 102 so as to form the encapsulant 101.

When the encapsulant 101 is implemented using the stacking process of FIG. 5, as illustrated in FIG. 4, at least a portion of the plurality of magnetic particles 111 may be disposed between the plurality of metal thin plates 110. The magnetic particles 111 are provided between the plurality of metal thin plates 110, so the encapsulant 101 could secure sufficient permeability.

The external electrodes 105 and 106 are disposed outside of the encapsulant 101 to be connected to the lead-out pattern L. The external electrodes 105 and 106 may be formed using a paste including a metal with excellent electrical conductivity. For example, the paste may be a conductive paste including one among nickel (Ni), copper (Cu), tin (Sn), and silver (Ag), or alloys thereof. Moreover, a plating layer may be further formed on the external electrodes 105 and 106. In this case, the plating layer may include at least one selected from the group consisting of nickel (Ni), copper (Cu), and tin (Sn), and for example, a nickel (Ni) layer and a tin (Sn) layer may be sequentially formed therein.

Figure 6:
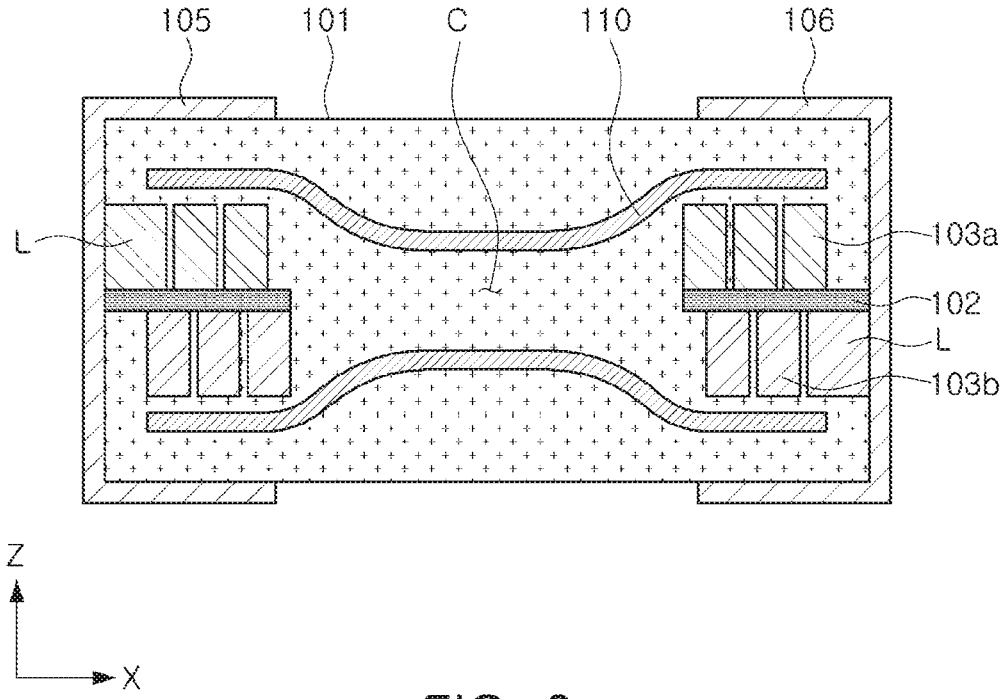
FIGS. 6 to 9 illustrate a coil electronic component according to a modified embodiment.
Figure 7:
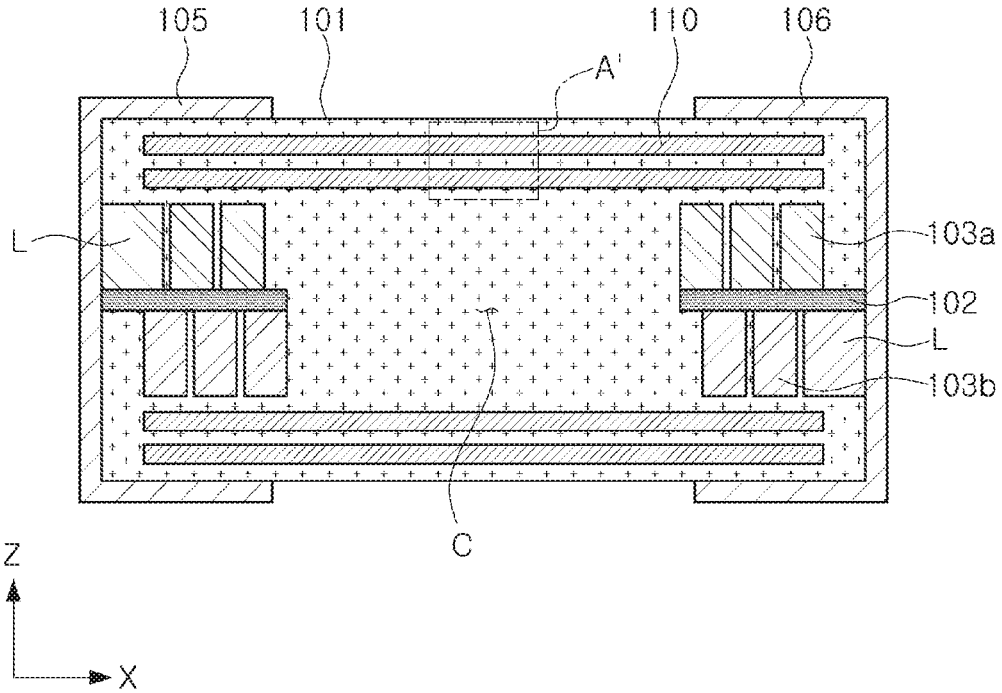

FIGS. 6 to 9 illustrate a coil electronic component according to a modified embodiment, and, among FIGS. 6 to 9, FIG. 8 illustrates an enlarged region A' of FIG. 7.

First, in the case of an embodiment of FIG. 6, one metal thin plate 110 is disposed in an upper portion of a first coil pattern 103*a*, while one metal thin plate 110 is disposed in a lower portion of a second coil pattern 103*b*. In other words, in a different manner from the preceding embodiment, a single metal thin plate 110 is disposed adjacent to each of the coil patterns 103*a* and 103*b*. In the case of a coil pattern 103 only having one of the first and second coil patterns 103*a* and 103*b*, that is, a single layer coil pattern, one metal thin plate 110 may be only provided in the encapsulant 101. The number of metal thin plates 110 may be selected in consideration of permeability of the encapsulant 101, structural stability, or the like.

Figure 8:
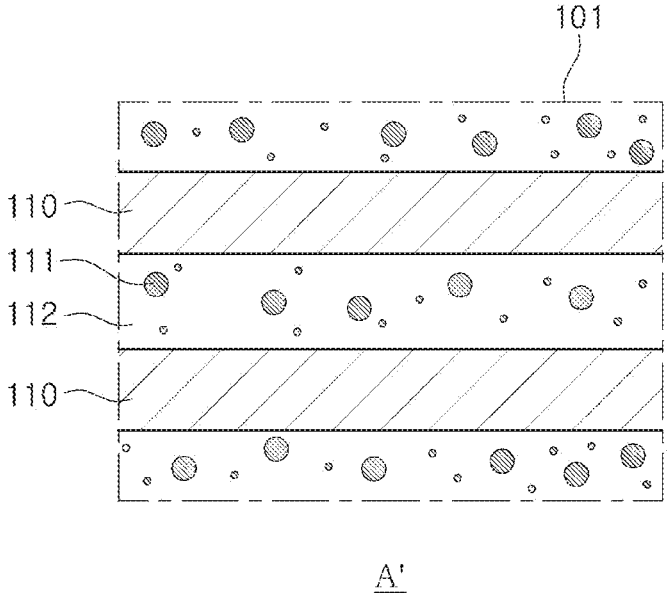
Figure 9:
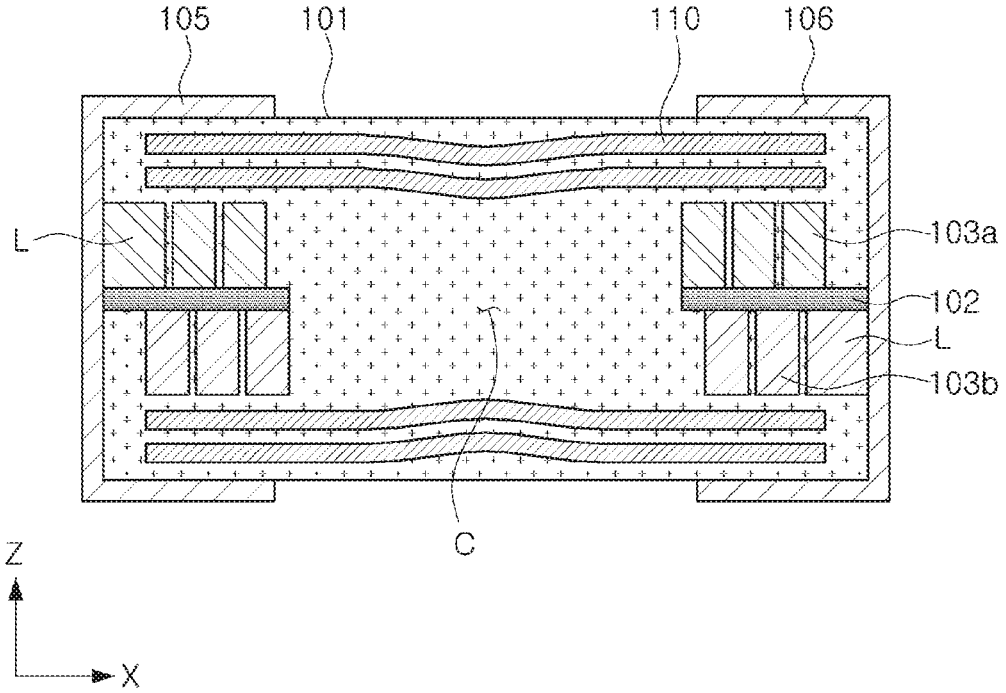

Next, in the case of embodiment of FIG. 7, in a manner different from the preceding embodiment, the metal thin plate 110 is not bent toward the core region C. In other words, the metal thin plate 110 has a substantially plate-shape. Regardless of use of the stacking process of FIG. 5, described above, for formation of the encapsulant 101, even when a shape of the metal thin plate 110 is maintained, the form described above may be obtained. For example, when the metal thin plate 110 is disposed distantly from the coil pattern 103 and close to a surface of the encapsulant 101, possibility of maintenance of the plate-shape of the metal thin plate 110 may be increased. However, even when a substantially plate-shape of the metal thin plate 110 is maintained, as illustrated in FIG. 8, a region of the metal thin plate may be bent toward the core region C. In this case, the bent region of the metal thin plate 110 may be close to a surface of the encapsulant 101 as compared with the coil patterns 103*a* and 103*b*. In this regard, as compared with the preceding embodiment, the metal thin plate 110 is slightly bent. In an embodiment of FIG. 7, at least a portion of the plurality of magnetic particles 111 may be disposed between the plurality of metal thin plates 110. Moreover, in a similar manner to the preceding embodiment, the plurality of magnetic particles 111 and the plurality of metal thin plates 110 may include the same material, and the same material may include an Fe-based alloy.

As set forth above, according to an embodiment in the present disclosure, in the case of a coil electronic component, flow of magnetic flux may be improved and permeability may be improved. Thus, performance of the coil electronic component may be improved.

While exemplary embodiments have been shown and described above, it will be apparent to those skilled in the art that modifications and variations could be made without departing from the scope of the present invention as defined by the appended claims.

What is claimed is:

1. A coil electronic component, comprising:

a support substrate;

a coil pattern disposed on at least a surface of the support substrate and having a core region in the center of the coil pattern;

at least one metal thin plate disposed on an upper portion of the coil pattern and having a shape bent toward the core region;

an encapsulant sealing at least a portion of the support substrate, the coil pattern, and the at least one metal thin plate; and an external electrode disposed outside of the encapsulant and connected to the coil pattern, wherein the encapsulant encapsulates the at least one metal thin plate in its entirety.

2. The coil electronic component of claim 1, wherein the at least one metal thin plate is provided as a plurality of metal thin plates and the plurality of metal thin plates are stacked in a thickness direction of the support substrate.

3. The coil electronic component of claim 2, wherein a metal thin plate, of the plurality of metal thin plates, further adjacent to the coil pattern, has a wider region bent toward the core region.

4. The coil electronic component of claim 2, wherein a plurality of magnetic particles are filled in an interior of the encapsulant.

5. The coil electronic component of claim 4, wherein at least a portion of the plurality of magnetic particles is disposed between the plurality of metal thin plates.

6. The coil electronic component of claim 4, wherein the plurality of magnetic particles and the plurality of metal thin plates include the same material.

7. The coil electronic component of claim 6, wherein the same material includes an Fe-based alloy.

8. The coil electronic component of claim 1, wherein a region, of the at least one metal thin plate, disposed in an upper portion of the coil pattern, has a flat shape.

9. The coil electronic component of claim 1, wherein a region of the at least one metal thin plate is disposed between the coil pattern and an outer side surface of the encapsulant.

10. A coil electronic component, comprising:

a support substrate;

a coil pattern disposed on at least a surface of the support substrate and having a core region in the center of the coil pattern;

a plurality of metal thin plates disposed in an upper portion of the coil pattern;

an encapsulant sealing at least a portion of the support substrate, the coil pattern, and the plurality of metal thin plates, and filled with a plurality of magnetic particles; and an external electrode disposed outside of the encapsulant and connected to the coil pattern, wherein at least a portion of the plurality of magnetic particles is disposed between the plurality of metal thin plates, and wherein the encapsulant encapsulates each of the plurality of metal thin plates in its entirety.

11. The coil electronic component of claim 10, wherein the plurality of magnetic particles and the plurality of metal thin plates include the same material.

12. The coil electronic component of claim 11, wherein the same material includes an Fe-based alloy.

13. The coil electronic component of claim 10, wherein a portion of the plurality of metal thin plates disposed on the upper portion of the coil pattern is parallel to the support substrate and a portion of the plurality of metal thin plates disposed in the core region is bent toward the support substrate.

14. The coil electronic component of claim 10, wherein at least one of the plurality of metal thin plates is parallel to the support substrate.

* * * * *